US005685489A

United States Patent [19]

Larsen

[11] Patent Number: 5,685,489

[45] Date of Patent: Nov. 11, 1997

[54] SHOWER HEAD

[75] Inventor: Finn Thorvald Larsen, Oslo, Norway

[73] Assignee: Norwec A/S, Norway

[21] Appl. No.: 615,230

[22] PCT Filed: Sep. 15, 1994

[86] PCT No.: PCT/NO94/00154

§ 371 Date: May 2, 1996

§ 102(e) Date: May 2, 1996

[87] PCT Pub. No.: WO95/07760

PCT Pub. Date: Mar. 23, 1995

[30] Foreign Application Priority Data

Sep. 16, 1993 [NO] Norway ..... 931870

[51] Int. Cl.[6] ..... B05B 1/32

[52] U.S. Cl. ..... 239/458; 239/524

[58] Field of Search ..... 239/443, 458, 239/505, 518, 523, 524, 539

[56] References Cited

U.S. PATENT DOCUMENTS

| | | | |
|---|---|---|---|
| 2,936,960 | 5/1960 | Thompson | 239/539 X |
| 3,022,014 | 2/1962 | Young | 239/458 X |
| 3,252,660 | 5/1966 | Hyde | 239/458 X |
| 3,416,734 | 12/1968 | Nelson | 239/460 |
| 3,826,427 | 7/1974 | Rutherford | 239/524 X |
| 4,095,747 | 6/1978 | Anderson | 239/443 X |
| 4,221,335 | 9/1980 | Shames et al. | 239/428.5 |
| 4,342,426 | 8/1982 | Gagliardo | 239/457 |

FOREIGN PATENT DOCUMENTS

| | | |
|---|---|---|
| 0 037 779 | 10/1981 | European Pat. Off. . |
| 2 418 677 | 3/1978 | France . |

*Primary Examiner*—Andres Kashnikow
*Assistant Examiner*—Steven J. Ganey
*Attorney, Agent, or Firm*—Leonard Bloom

[57] ABSTRACT

A shower head includes a mouthpiece having a central, axial, throughgoing channel for flow-through of water. A rotationally symmetrical deflector element for the water is situated in the vicinity of the outer mouth of the channel. The mouthpiece is in threaded connection with a support through which the water is supplied and is adapted to be adjusted axially relatively to the support. The deflector element is carried by a stem which extends axially in the channel with a radial clearance and is fastened to the support. On the side facing the channel, the deflector element is concave, in that a circumferential groove having a curved cross section extends around the stem. The region of the mouthpiece around the deflector element provides a conical surface which extends converging outwardly. The shower head reduced water consumption at low water pressure and also permits pulsating showering.

5 Claims, 1 Drawing Sheet

SHOWER HEAD

The present invention relates to a shower head as disclosed in the preamble of the succeeding claim 1.

For several years shower heads have been developed with a view to low water consumption ("saving showers"), in the range of 6 to 10 l/min. This consumption is usually based on normal water pressures, which are 3 to 5 kp/cm$^2$. As the consumption is at a "saving level" already at such normal pressures, a lower pressure will cause that the consumption will be lower than desired at low pressures. The water consumption is reduced to below the "limit of comfort" and causes negative attitudes to such shower heads.

Shower heads able to cause pulsating spray have been known for a long time. These are based on the use of a propeller-like rotor inside the shower head. Such shower heads can usually be converted between a normal condition for an even shower and the pulsating shower.

Such shower heads are usually designed for a high water consumption, and they are complicated.

In the development of shower heads for low water consumption, the aim has been to achieve low water consumption and has not considered other factors. No accounting has been taken of the consequences with respect to effect, comfort and the nature of the water flowing out of the shower heads. This has, on the one hand, in most of the cases caused low water velocities and a less favourable water structure and on the other hand designs which may cause clogging due to impurities or lime in the water.

The present invention brings about a shower head which causes a low water consumption at normal water pressure, which in a less degree than known "saving showers" reduces the water consumption at low water pressure and which additionally can be converted between a normal condition for showering and a condition for pulsating showering ("massage showering"), whereby the latter condition is achieved without any rotating element in the shower head.

The shower head according to the invention is characterized by the features appearing from the succeeding claim 1.

When the mouthpiece has been screwed approximately to a maximum into the support and the deflector element, consequently, is approximately in its greatest distance from the mouth of the channel, relatively large water drops having a relatively large mutual distance and a large velocity are formed, which leave the deflector element in a conical surface. Some of the water hits the wall in the cavity, and the water is reflected from the wall and leaves the mouthpiece and forms a relatively homogeneous structure.

When the mouthpiece is screwed further from the support, so that the deflector element is closer to the mouth of the channel, an increased choking will take place at the deflector element, but this position is well suited for low water pressures, in that a relatively larger water consumption and a comfortably feeling water velocity is achieved. When the mouthpiece is screwed approximately to its terminal position away from the support, and the deflector element, consequently, is in a maximum proximity to the mouthpiece, instability of the water will occur, and it will flow out in a pulsating manner, i.e. that the drops will flow out in "clusters".

That the surface surrounding the deflector element mainly is conical and converges outwardly from the bottom surface in the mouthpiece is of importance to the mode of flow past the deflector element.

In an embodiment of the invention a feature has been developed which has been found to be particularly advantageous, this being that the stem is conical, at least in the portion situated remote from the deflector element. That the stem is conical has a direct influence on the cross section of the water flow at the top of the channel. This cross section will be at a minimum when the mouthpiece has been screwed maximally into the support. At the same time the deflector element is in its maximum distance from the mouth of the channel. Hence, the major part of the choking will take place at the top of the channel. The effect of this is the above mentioned relatively large drops of water. When, to the contrary, the mouthpiece has been screwed maximally outwardly relatively to the support, this cross section is at its maximum. At the same time the deflector element is at its minimum distance from the channel. Hence, the major part of the choking will take place at the deflector element. This permits an acceptable water velocity and an acceptable water consumption also when the supplied water is at low pressures.

The invention will in the following be further explained, by means of an embodiment shown in the accompanying drawing.

Figure 1:
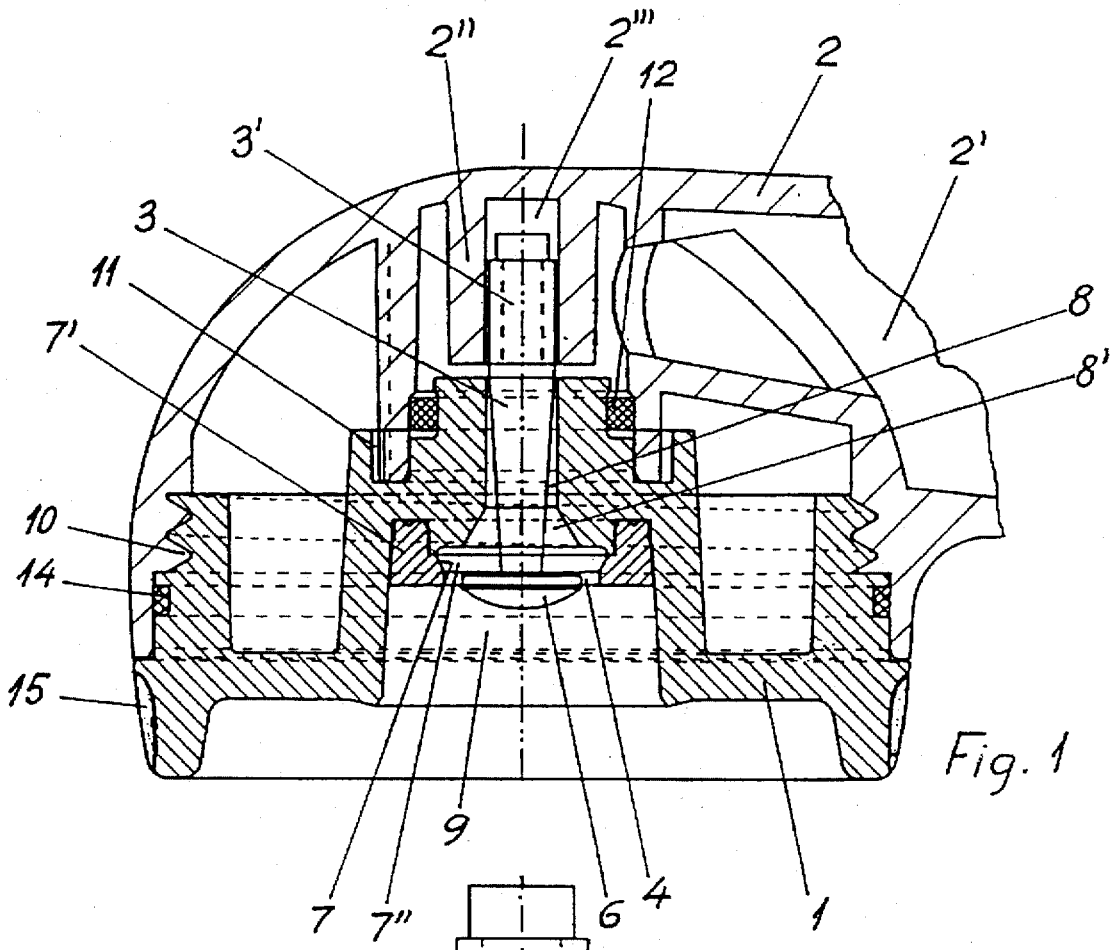
FIG. 1 shows a shower head in accordance with the invention, in a section axially through the center of the mouthpiece. The scale of FIG. 1 is approximately 2:1.

The section shown in FIG. 1 also intersects a channel 2' for supply of water in the support 2, of which only a portion near the shower head is shown. It will be appreciated that the support in a known manner can be shaped as a handle or be equipped with means for being fastened to a wall stand, possibly as a combination of a handle and fastening device.

The shower head comprises a mouthpiece 1, which by means of threads 10 has been screwed into a support 2. The threads are also used to adjust the axial position of the mouthpiece 1 relatively to the support 2. A stop 11 may be provided in order to limit the possibility of such adjustment. FIG. 1 shows ribs 15 on the mouthpiece 1, distributed around its circumference, in order to permit a good grip for screwing the mouthpiece 1 relatively to the support 2. FIG. 1 also shows a gasket ring 14 near the threads 10, but this ring is of little importance and can be omitted.

The support 2 contains a channel 2' for supply of water.

The mouthpiece 1 has an inner cavity 9 which is open for discharge of water and which is approximately cylindrical at the bottom. Through an axial channel 8 the cavity 9 communicates with the inner channel 2' in the support 2.

A conical surface 7 has in the example shown been formed on a ring 7' inserted in the cavity 9. The ring 7', which may be made of plastics, can be fastened in an interference fit, but is also possible to fasten the ring by welding, for instance by ultrasonic welding, when also the mouthpiece 1 is made of plastics. The ring 7' may also be screwed into threads. The surface 7 may be formed by the mouthpiece 1 itself, but due to the direction of taper of the surface 7 it is considered to be simpler from reasons of manufacture that the surface 7 is situated on a separate ring. Thereby the mouthpiece 1 can be cast by use of a directly removable core.

The support 2 contains a boss 2" having a threaded bore 2'", and into the bore 2'" has been screwed one end 3' of a stem 3, the end 3' having threads 3". On its distal end, in the cavity 9, the stem 3 carries an approximately disc-shaped deflector element 6, which on the side facing the channel 8 has been shaped with a circumferential groove 6' around the end of the stem 3. The groove 6' is shown by a dotted line in FIG. 2. Between the periphery of the deflector element 6 and the conical surface 7 is an annular gap 4, which is altered by screwing the mouthpiece 1 axially relatively to the support 2. The stem 3 has a smaller diameter than the channel 8, so that water can flow in an annular space between the stem 3 and the wall of the channel 8. The end of the channel 8 facing the deflector element 6 can be conically diverging. The axially outermost surface 6" on the deflector element 6 is shown having the shape of a dome, but this surface is not considered to have any substantial influence on the flow of water.

Together with the deflector element 6 the surface 7 forms an annular chamber 7", whose shape and size is altered when the mouthpiece 1 is screwed axially relatively to the support 2, and the chamber 7" influences the water in different ways, depending on its shape and size.

The conical surface 7 does not need to be conical along its entire length. The surface 7 may be cylindrical or approximately cylindrical farthest out, towards the cavity 9. The channel 8 may be mainly cylindrical, but in the vicinity of the chamber 7" the channel 8 may have a conical portion 8' as shown in FIG. 1.

A feature which has been found to be advantageous is that the stem 3, at least in the region situated innermost in the channel 8 (nearest to the boss 2"), is conical or otherwise has a varying cross section, in such a manner that the cross section is largest towards the fixed end 3' of the stem 3. Presupposed that the channel 8 has a constant cross section in this region it is achieved that the flow-through cross section of the water innermost in the channel 8 is altered when the mouthpiece 1 is screwed axially relatively to the support 2.

When the mouthpiece 1 has been screwed approximately maximally into the support and the deflector element 6, consequently, is approximately in its largest distance from the outer mouth of the channel 8, relatively large drops of water having a relatively large mutual distance and a large velocity are formed, and leave the deflector element 6 in a conical surface. Some of the water hits the wall in the cavity 9, and the water is reflected from the wall and leaves the mouthpiece 1 and forms a rather homogeneous structure.

When the mouthpiece 1 has been screwed farther out relatively to the support 2, whereby the deflector element 6 is closer to the mouth of the channel, an increased choking will occur in the gap 4 at the deflector element 6. This position is well suited for low water pressures, in that a relatively larger water consumption and a comfortably feeling water velocity is achieved.

When the mouthpiece 1 has been screwed approximately to its end position outwardly from the support 2, whereby the deflector element 6, consequently, is in a maximum proximity to the mouthpiece 1, unstability of the water will occur, and it will flow out in a pulsating manner and give the feeling of massage.

The fact that the surface 7 surrounding the deflector element 6 mainly is conical and converges outwardly from the bottom surface of the mouthpiece 1 influences the mode of outflow of the water past the deflector element 6.

A sealing ring 12, shown as an O-ring, is inserted in an annular space between the support 2 and the mouthpiece 1. The ring prevents pressure drops due to leakage and also prevents ingress of water into the cavity shown between the support 2 and the mouthpiece 1 and the creation of unsanitary conditions in that the water remains in the cavity for a long time.

Figure 2:
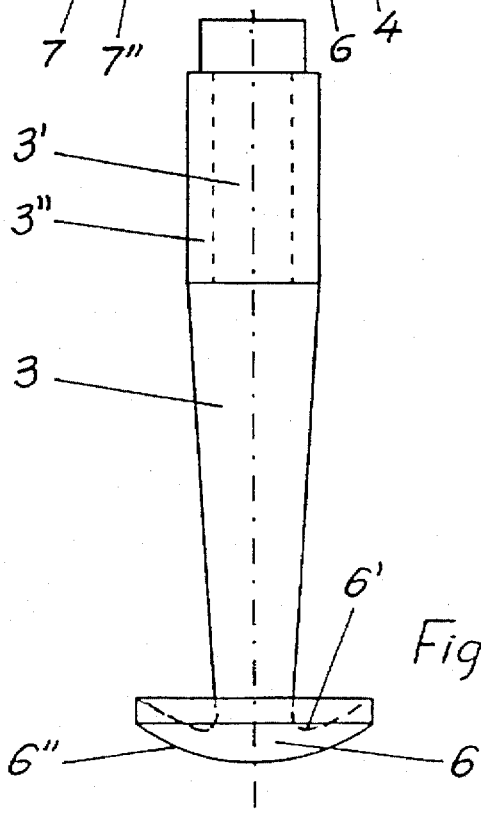
FIG. 2 shows in a larger scale (approx. 4:1) the deflector element contained in the shower head.

The groove 6' shown in FIG. 2 has such a cross sectional shape that the groove 6' is deepest nearest to the stem. This constitutes a non-limiting example. The groove has a curved cross section, but the shape may vary.

It will be appreciated that the respective components in the shower head may consist of plastics or metal, except from the O-ring 12 and the possible gasket ring 14, which may be made of synthetic rubber or natural rubber. The support 2 and the mouthpiece 1 may for instance be cast, but it is considered most convenient that the stem 3 and the deflector element 6 are manufactured in one piece by mechanical processing, i.e. mainly turning and cutting of threads.

I claim:

1. A shower head comprising a mouthpiece (1) having a central, axial, throughgoing channel (8) for flow-through of water, whereby a rotationally symmetrical deflector element (6) for the water is situated in the vicinity of the outer mouth of the channel, the mouthpiece (1) being in threaded connection with a support (2) through which the water is supplied and is adapted to be adjusted axially relatively to the support, while the deflector element (6) is carried by a stem (3) which with a radial clearance extends axially in the channel and is fastened to the support (2), characterized in that the deflector element (6) on the side facing the channel (8) has a concave circumferential groove (6') having a curved cross section around the stem (3), and that the region of the mouthpiece (1) around the deflector element (6) or immediately axially inside thereof, provides a conical surface (7) which extends converging outwardly and turns into a mainly cylindrical surface nearest to its free end, there being an annular gap (4) between the deflector element (6) and the conical surface (7).

2. A shower head as disclosed in claim 1, characterized in that the surface (7) is situated on a separate ring (7').

3. A shower head as disclosed in claim 1, characterized in that the stem (3) is conical at least in the portion situated farthest from the deflector element (6), whereby the surface of the stem converges towards the deflector element, and in such a manner that the cross section of flow-through of water is altered by axial movement of the mouthpiece (1) relatively to the support (2).

4. A shower head as disclosed in claim 1, characterized in that the mouthpiece (1) defines a cavity (9) around and axially outside of the deflector element (6).

5. A shower head as disclosed in claim 1, characterized in that the curved cross section of the circumferential groove (6') is deepest nearest the stem (3).

* * * * *